US006142839A

United States Patent [19]

Wilcox

[11] Patent Number: 6,142,839

[45] Date of Patent: Nov. 7, 2000

[54] MOTOR MOUNTING SYSTEM FOR AN INFLATABLE BOAT

[76] Inventor: Luman L. Wilcox, 3126 E. 67th St., Tulsa, Okla. 74136

[21] Appl. No.: 09/158,979

[22] Filed: Sep. 15, 1998

[51] Int. Cl.[7] ..... B60L 1/14

[52] U.S. Cl. ..... 440/6; 114/345; 248/641; 441/132

[58] Field of Search ..... 440/6, 49, 113, 440/900; 114/345; 248/641; 441/132

[56] References Cited

U.S. PATENT DOCUMENTS

| | | | |
|---|---|---|---|
| 3,324,488 | 6/1967 | Schulz, Jr. | 9/1 |
| 3,665,534 | 5/1972 | McIntyre | 9/2 A |
| 3,881,442 | 5/1975 | Seiple | 115/0.5 B |
| 4,021,873 | 5/1977 | Francois | 9/2 A |
| 4,371,144 | 2/1983 | Godlewski | 248/641 |
| 4,911,094 | 3/1990 | Akers | 114/346 |
| 4,915,047 | 4/1990 | Lord et al. | 114/39.26 |
| 4,938,722 | 7/1990 | Rizley | 440/6 |
| 5,081,947 | 1/1992 | Holden | 114/345 |
| 5,090,930 | 2/1992 | Walden | 441/131 |
| 5,485,981 | 1/1996 | Lindahl | 248/641 |
| 5,601,461 | 2/1997 | Mills | 440/6 |

*Primary Examiner*—S. Joseph Morano
*Assistant Examiner*—Andrew Wright
*Attorney, Agent, or Firm*—Head, Johnson & Kachigian

[57] ABSTRACT

A mounting system for an inflatable boat of the type having opposed first and second tubular gunwale sections extending from a tubular U-shaped stern section including a band horizontally positionable on a rearward surface of the U-shaped stern, a first strap that encircles the first gunwale section and secured to the band adjacent one end thereof, a second strap that encircles the second gunwale section and secured to the band adjacent the other end thereof, a bracket secured to the band at the boat stern and receiving a battery therein, a submersible motor having a horizontal propeller shaft rotatably extending therefrom to which is affixed a propeller, the motor being positioned beneath and supported by the bracket, and a motor control supported to a gunwale section of the boat and electrically interposed between the battery and the motor.

7 Claims, 3 Drawing Sheets

MOTOR MOUNTING SYSTEM FOR AN INFLATABLE BOAT

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

Fishing is one of the most popular types of outdoor recreation. We all remember the ideal picture of a boy sitting on a riverbank with a cane pole and a can of worms. Others fish from the bank of a lake or stream by casting into the water and retrieving the bait utilizing a manually operated reel. Most fishing today, however, particularly in the United States, Canada and other industrial nations, is done by the use of a boat, normally a power boat with an outboard or inboard motor or inboard/outboard motor. By use of a boat a fisherman can access many fishing spots in a relatively short time compared to the opportunities available to a fisherman that does not have a boat and is limited to fishing spots available from the bank of a lake or stream.

In spite of the great advantages of the use of a motorboat for outdoor fishing, motorboats themselves are a serious handicap to the devoted fisherman. They must be transported by a trailer, unless stored in a permanent dock in a facility on a lake. If transported by a trailer, loading and unloading a boat is time consuming and burdensome. Further, motorboats, including the trailers and equipment that go with them are relatively expensive. Further, motorboats are noisy and polluting.

A compromise that is becoming more popular with fisherman is the use of a one-person inflatable boat. The improvements that have been made in plastics and other fabrics of which inflatable boats can be economically manufactured has contributed to their popularity. The typical fisherman using an inflatable boat can transport the boat in a car trunk, that is, without the need of a trailer. The boat is easily launched into and retrieved from a river or lake. An inflatable boat offers the opportunity of a fisherman to move about to find fishing spots that are otherwise inaccessible to a fisherman that is limited to fishing from the bank of a river or stream. Further, one-person inflatable boats allow a fisherman the peace and solitude that is more or less destroyed by the use of motorboats.

Typically an inflatable boat is moved about on water by a fisherman paddling with his feet. In recent times the concept of employing a battery powered submersible motor for an inflatable boat has become of interest since it increases the maneuverability of an inflatable boat, reduces the energy required for fishing and thereby increases the overall enjoyment of a fishing experience.

For background information relating to the concept of adding an electric powered submersible motor to an inflatable boat reference may be had to the following previously issued United States patents:

| PATENT NO. | INVENTOR | TITLE |
|---|---|---|
| 3,324,488 | Schulz, Jr. | Aquatic Floater |
| 3,665,534 | McIntyre | Fishing Float Motor Support |
| 3,881,442 | Seiple | Motor Mount For An Inflatable Boat |
| 4,021,873 | Francois | Circular Watercraft |
| 4,371,144 | Godlewski | Motor Securing Device For Watercraft |
| 4,911,094 | Akers | Powered Floater |
| 5,081,947 | Holden | Boat Assembly |
| 5,090,930 | Walden | Power-Driven Float Assembly |
| 5,485,981 | Lindahl | Motor Mount Assembly For Float Tube |
| 5,601,461 | Mills | Float Tube Propulsion Apparatus |

BRIEF SUMMARY OF THE INVENTION

This invention relates to a motor mounting system for use on an inflatable boat. The system is particularly useful on an inflatable boat of the type having opposed first and second tubular gunwale sections extending from a tubular U-shaped stern section. The motor mounting system consists of a band, usually made of a strong material such as tough aluminum and tough plastic, horizontally positioned on the rearward surface of the U-shaped stern portion of the inflatable boat. The band has opposed first and second ends. A first strap is used to encircle a first gunwale section of the inflatable boat and is secured to the band adjacent the first end thereof. The second strap encircles the second gunwale section of the inflatable boat and is secured to the band adjacent the second end thereof.

In a preferred arrangement a Velcro® attachment system is positioned between an inner surface of the band and a horizontal portion of the boat stern section so that when the band is positioned in engagement with the boat the Velcro® attachment system helps secure the center portion of the band in its proper position on the boat U-shaped stern portion.

A bracket is secured to the band, the bracket being preferably detachable from the band for a convenience of transportation and storage. The bracket provides an open top basket like system that is particularly configured and adapted to receive therein a battery box. Secured to the bracket is a submersible motor that has a horizontal propeller shaft rotatably extending from it. A propeller is affixed to the shaft. The motor is positioned with respect to the bracket so that the propeller is directly underneath the battery box when the battery box is positioned within the bracket. The battery box has a flat lower surface that functions as an anti-cavitation plate for the propeller. Alternatively, a flat sheet of material may be positioned in the bracket on which the battery box rests but in either event whether by a separate sheet of material or the bottom surface of a battery box the bracket is configured and designed with an anti-cavitation plate is provided for the propeller.

The function of the anti-cavitation plate is to reduce the possibility that air will be drawn from the surface to surround the propeller when the propeller is in operation. Substantially all outboard motors that drive a propeller positioned at a relatively shallow depth below the water surface are provided with an anti-cavitation plate. A feature of the invention herein is the provision of such anti-cavitation plate without the necessity of a separate specific element being attached to the motor itself.

A battery is positioned within the battery box and electrical wiring extends from the battery to the motor for providing energy for powering the motor. A control box is secured by a strap to one of the gunwales of the inflatable boat in a position for convenience of use by the operator. The control box typically includes at least a switch that can, in a center position, turn the motor off, in a forward position, turn the motor so that the propellers rotate to forwardly advance the boat and in an opposite position of the switch, turn the motor propeller in an opposite direction to rearwardly advance the boat.

Inflatable boats that are currently available on the market for the use by a single fisherman are typically engineered so that when a fisherman sits in the boat his legs extend downwardly in the water and he sits uprightly with his arms comfortably above the boat gunwales so that he can freely operate a fishing rod. When a system for supporting an electric driven motor is attached to such an inflatable boat it is important that the motor mounting system, including the battery, the motor and the supporting frame work does not materially alter the buoyancy of the inflatable boat so as to cause a fisherman to set deeper in the water than normal or to cause the boat to tilt. One of the unique features of the invention herein is the positioning of the bracket and the battery box held by the bracket in such a way that buoyancy provided by the battery box at least substantially offsets the weight of the battery contained therein, the submersible motor and the bracket so that when the motor mounting system of this invention is attached to a typical commercially available inflatable boat the ride of the boat on the water with a fisherman in it is not materially changed from that which exists without the motor mounting system.

A better and more complete understanding of the invention will be obtained from the following description of the preferred embodiment and the claims, taken in conjunction with the attached drawings.

DESCRIPTION OF THE DRAWINGS

In FIG. 2 a fisherman is shown in the boat.

DETAILED DESCRIPTION OF THE PREFERRED EMBODIMENTS

Figure 1:
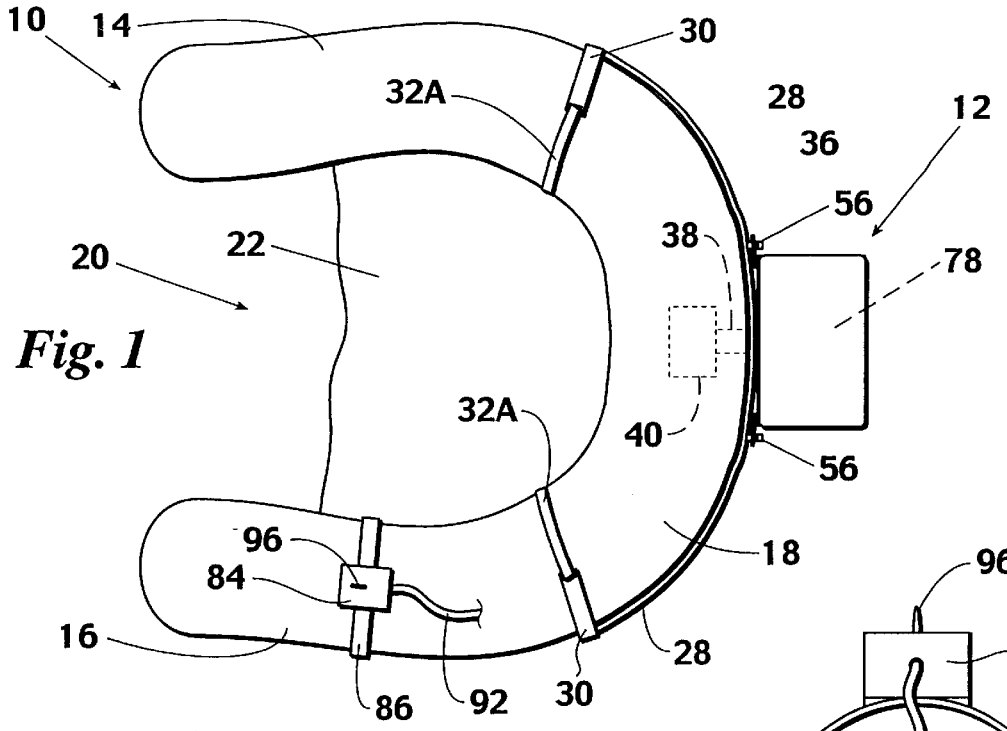
FIG. 1 is a top plan view of a typical U-shaped inflatable boat that has first and second forwardly extending gunwale portions and an integral U-shaped stern portion and showing the motor mounting system of this invention attached to the boat.
Figure 2:
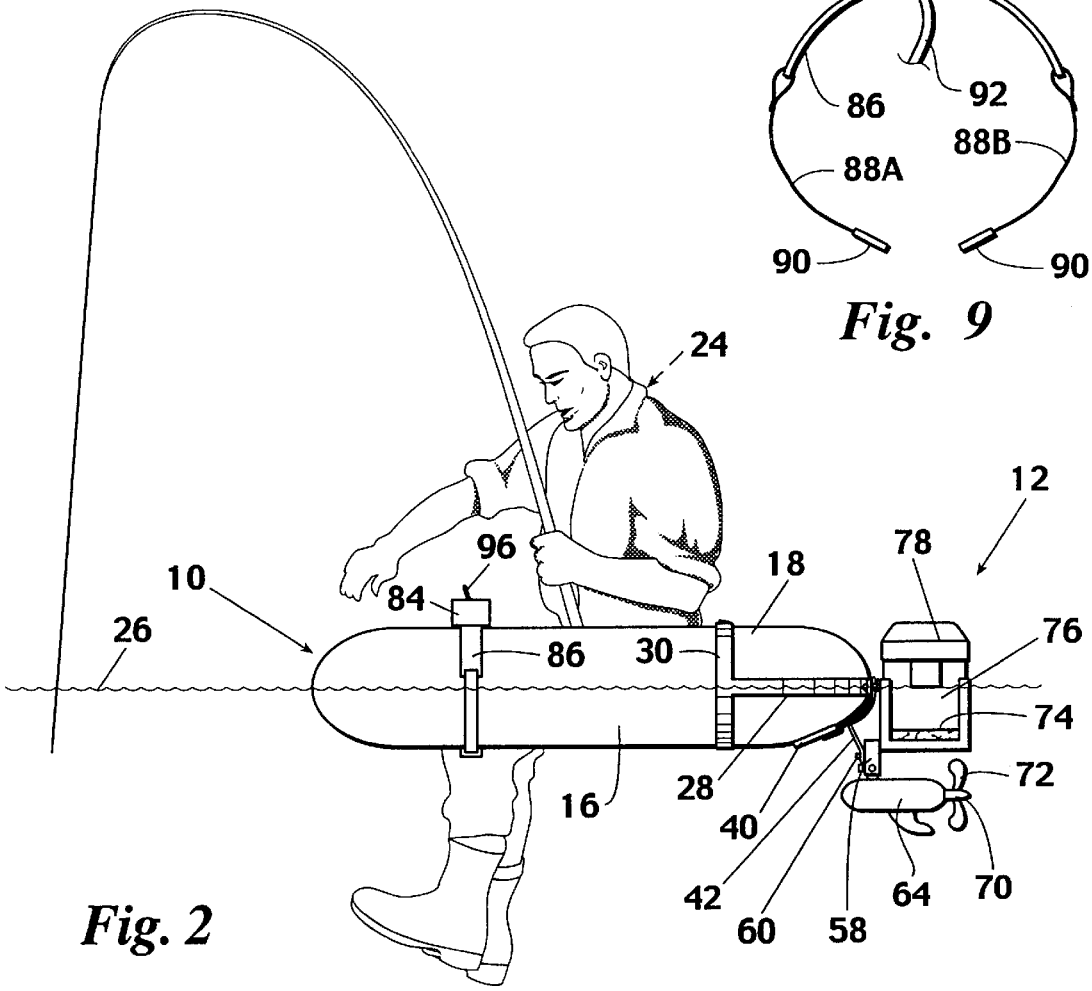
FIG. 2 is an elevational view of the boat shown in FIG. 1 with the motor mounting system of this invention attached to it.

Referring first to FIGS. 1 and 2 the basic environment in which the invention is used is best understood. FIG. 1 is a top plan view of a typical U-shaped inflatable boat indicated generally by the numeral 10. The motor mounting system that is adapted for use with boat 10 is indicated generally by the numeral 12. An inflatable boat can take many configurations. The first and still a commonly used type of inflatable boat to which this invention is applicable is shaped like a doughnut or a large inner tube. From this basic configuration improved inflatable boats have evolved so that today a typical type of manufactured inflatable boat for use by one person is U-shaped as illustrated in FIG. 1. The boat has opposed tubular gunwales 14 and 16 with an integral tubular U-shaped stern 18. This arrangement leaves an open forward end 20 for the convenience of a fisherman that is particularly important when landing a fish. The typical U-shaped boat includes a seat 22 that stretches between the gunwales 14 and 16 and the stern portion 18 allowing a fisherman, indicated by the numeral 24 in FIG. 2, to sit with his feet extending down into the water, the water surface being indicated by the numeral 26 in FIG. 2.

Boats of the type described to this point are representative of inflatable crafts in which a fisherman sits. Frequently the fisherman has devices attached to his feet (not shown) by which he can maneuver the boat. However, manually propelling the boat can employ considerable energy, particularly under windy conditions or if the fisherman wishes to explore a wide area of a body of water. For this reason, in recent years there has been a renewed interest in providing a power driven means for moving the inflatable boat while in the water and it is to this need that this invention is directed, the invention being the motor mounting system generally indicated by the numeral 12.

The basic superstructure of the motor mounting system is illustrated in FIGS. 3, 4, 5 and 6 and consists of a band 28 of stiff but bendable material, such as stiff plastic, or aluminum metal. Band 28 may be approximately ½ to 2 inches in height and of length approximately 4–5 feet to extend around the stern portion 18 of an inflatable boat. Band 28 has opposed ends. A strap 30 is attached to each ends of band 28 by which it is secured to the boat gunwales 14 and 16. By the term "straps" is meant a circumferential device by which the ends of the bands are removably attached to the gunwales. In the illustrated embodiment each of the straps includes a semi-circular band 30 that can be made of the same material as band 28, that is, as an example, aluminum. Affixed to the opposed ends of the semi-circular bands 30 is a flexible strap having portions 32A and 32B, the strap portions being joined together by a buckle 34. By use of band 30, straps 32A, 32B and buckle 34 the outer ends of the horizontal band 28 can be secured to the stern of the boat and held in place.

Figure 3:
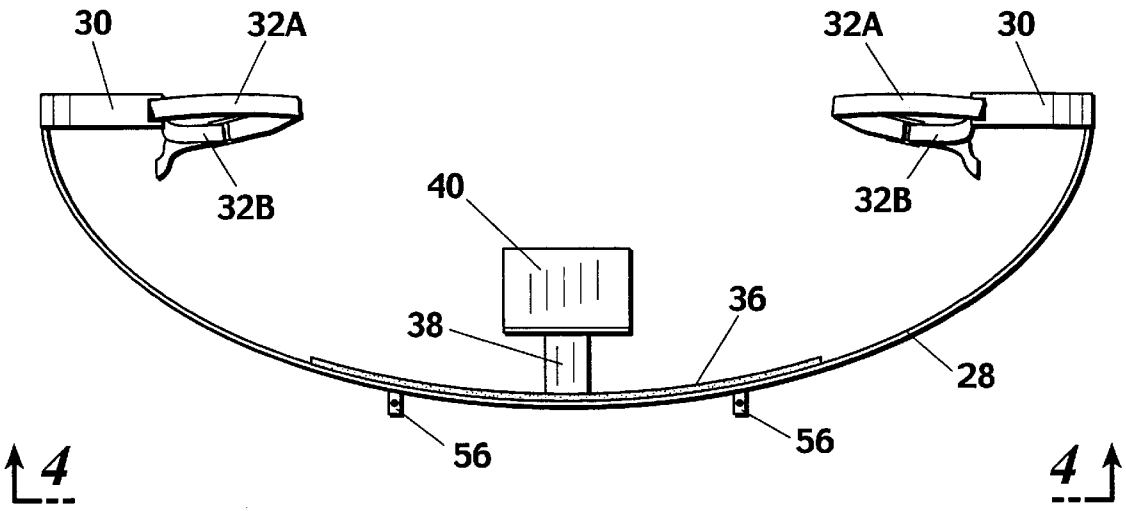
FIG. 3 is a top view of the basic structural framework of the motor mounting system showing a band that is attached to the stern portion of a U-shaped inflatable boat.

To further secure horizontal band 28 to the stern portion 18 of boat 10, a Velcro strip first portion 36, such as the looped portion, is secured to its inside surface as seen in FIG. 3. The other portion of a Velcro® strip, such as the hooks portion, is secured to the boat stern portion 18 in the area that is contacted by the horizontal band 28.

As shown in FIGS. 2 through 5, extending downwardly from a mid portion of horizontal strap 28 is a shank 38 having on the downward end thereof a pad 40, the pad fitting an underneath exterior surface of the boat stern 18 as seen in FIG. 2. The function of pad 40 is to stabilize the motor mounting system including the battery and motor components as will be described subsequently. Extending downwardly and rearwardly from shank 38 is a bracket 42 having a hole 44 in it.

Figure 6:
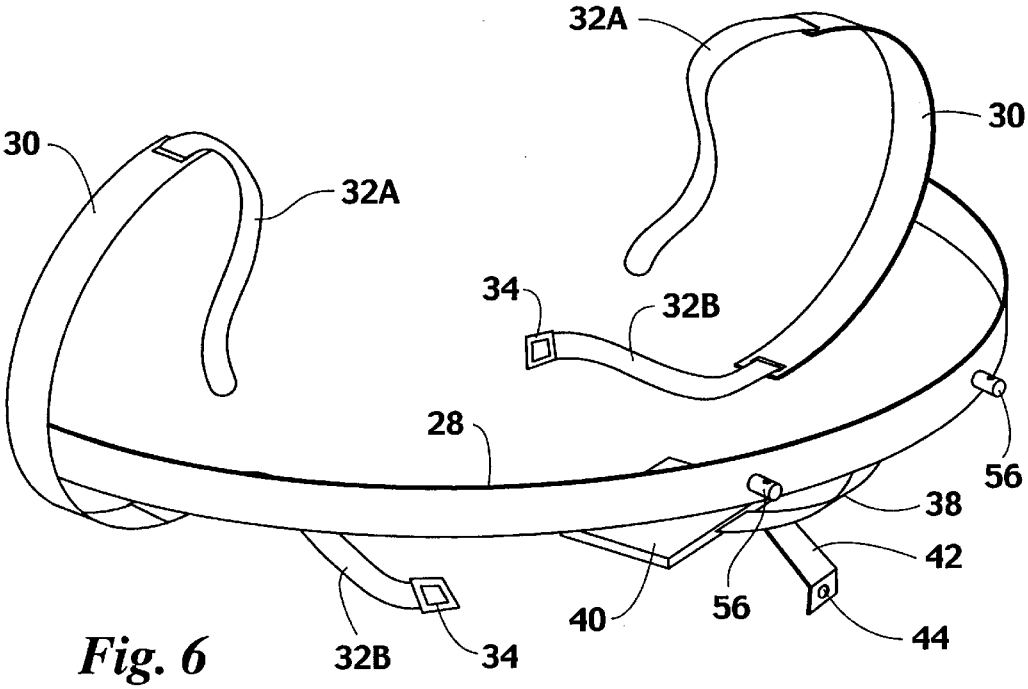
FIG. 6 is an isometric view of the band shown in FIGS. 3 through 5.

FIG. 6 is an isometric view of the basic structure that is attached to the stern section of an inflatable boat as has been described.

Figure 7:
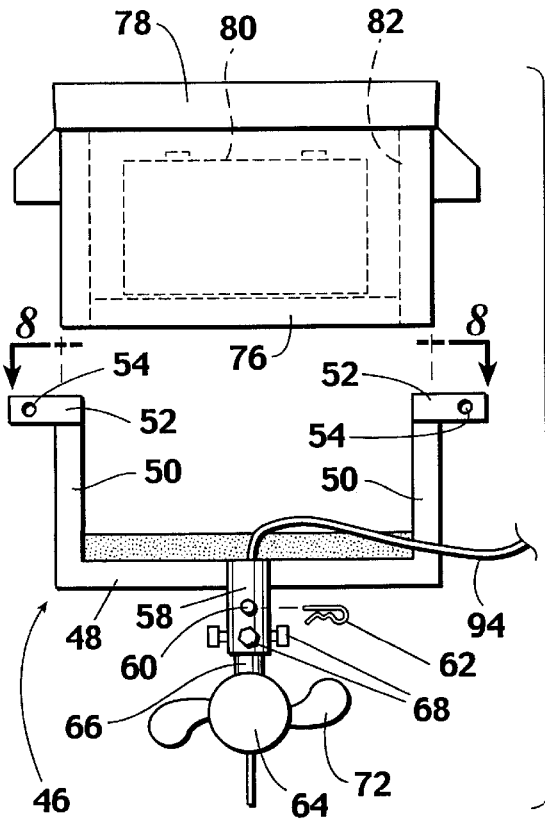
FIG. 7 is an exploded view of the bracket system that is removably secured to the band of FIGS. 3 through 6 and shows a battery box that is removably positionable within the bracket, the battery box having a battery therein, the battery being shown in dotted outlines.
Figure 8:
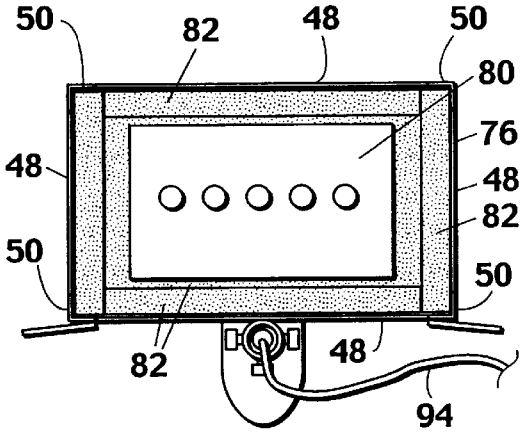
FIG. 8 is a top plan view of the bracket with a battery box therein that has a battery in it. The cover has been removed from the battery box in FIG. 8.

Removably attached to the motor mounting attachment system of FIG. 6 is a battery box bracket generally indicated by the numeral 46 that, as seen in FIGS. 2, 7 and 8 is formed of angular metal members, such as aluminum. The battery box bracket consists of horizontal portions 48 forming a closed rectangle with, at each corner of the rectangle, vertically extending posts 50. Attached to the upper ends of the two forward most vertical angular posts 50 are horizontally extending brackets 52, each with a hole 54 therein. Holes 54 match spaced apart pins 56 that extend rearwardly from horizontal band 28.

Affixed to the forward most horizontal angular portion 48 of battery box bracket 46 is a vertical, downwardly extending short length tubular post 58. Extending forwardly of post 58 is a pin 60.

Battery box bracket 46 is removably secured to horizontal band 28 by fitting the bracket holes 54 over pins 56 that extend rearwardly from band 28 and positioning pin 60 that extends from tubular post 48 through the openings 44 in bracket 42. Three clips 62 (See FIGS. 4 and 5) are then inserted through opening in pins 56 and 60 to retain the battery box bracket to band 28.

Removably attached to downwardly extending tubular post 58 is an electric powered submersible motor 64. As seen in FIG. 7, the motor has an upwardly extending mounting member 66 that is received within tubular post 58. By means of bolts 68, motor 64 is secured to post 58 and thereby to battery box bracket 46.

Motor 64 has a horizontal rearwardly extending shaft that supports a hub 70 that is integral with a propeller 72.

Horizontally positioned within battery box bracket 46 is a sheet of cellular foam plastic 74 and resting on this plastic sheet is a battery box 76 that has a removable cover 78. Battery box 76 and removable covers 78 are commonly used with boats either for powering trolling motors or starting motors for gasoline powered engines, and are typically made of tough plastic. FIG. 8 shows a top view of the battery box bracket 46 with battery box 76 therein with the cover removed.

Resting within battery box 78 is a battery 80. Normally battery 80 is of dimensions smaller than the interior of box 76 and the space is filled with sheets of cellular foam plastic 82. The use of these plastic foam sheets is optional but very useful in taking up extra space within the battery box and to add flotation in the event the battery box is overturned.

Figure 9:
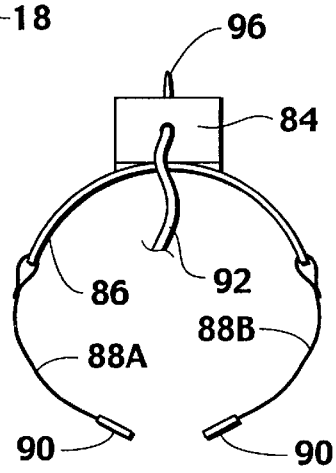
FIG. 9 is an elevational view of a control box and a strap to secure it to a gunwale of an inflatable boat, by which electrical power from the battery to the motor is controlled.

Turning now to FIGS. 1, 2 and 9, a control box 84 includes a band 86 that conforms to the tubular gunwale 16, the band having straps 88A and 88B and a buckle 90 by which the straps are connected together providing means for removably securing the control box to the boat and allowing it to be positioned for convenience of the boat user. A conductor 92 extends from control box 84 and from motor 64, the conductor 94 being seen in FIGS. 7 and 8. A conductor (not shown) is connected to the posts of battery 80. By simple wiring these conductors in a simple circuit arrangement the control box 84 is used to energize the motor 64 to cause the propeller 72 to turn in either the forward or rearward direction. Thus, control box 84 may in its simplest embodiment include a three-position toggle switch 96 having a central off position, a forward position to cause motor 64 to rotate propeller 72 to move the boat in a forward direction and a rearward position to cause the motor to reverse. A more sophisticated control can be employed including speed control if desired.

Figure 4:
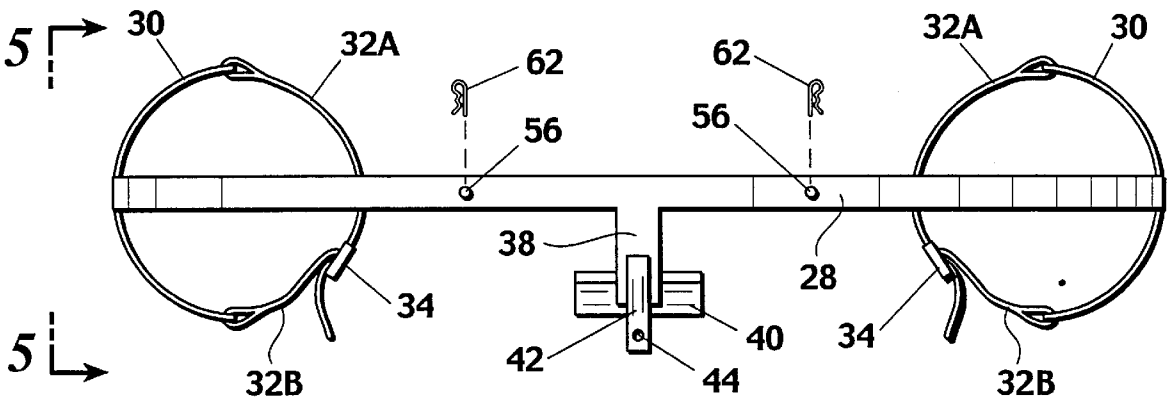
FIG. 4 is a rearward elevational view taken along the line 4—4 of the band of FIG. 3.
Figure 5:
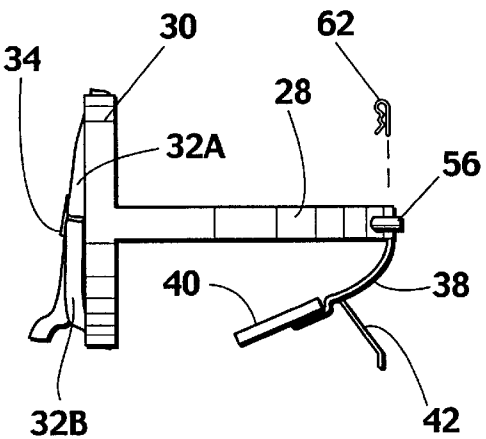
FIG. 5 is a side view taken along the line 5—5 of FIG. 3 showing the band.

There are many advantages to the motor mounting system as has been illustrated and described herein which may not be apparent merely from the drawings and the description. A first advantage is the simplicity of the system and its economy of cost and weight. The superstructure system, that is, the brackets and so forth as shown in FIGS. 3, 4 and 5 provide a method of mounting the necessary equipment to an inflatable boat in a way that employs very little weight. It can be expeditiously affixed to an inflatable boat or removed from it merely by removing straps and the Velcro® attachment. Further, the battery box bracket 46 can be expeditiously attached to the band 28 by removing three pins 62. The battery box bracket is lightweight and provides only a skeletal structure to removably receive a battery box 76. Further, the motor 64 is easily attached to the battery box bracket 46 by means of bolt 68 so that these two components can be quickly disassembled. In other words, the system can expeditiously be disassembled for convenience of storage or transportation in a relatively small space such as in the trunk of a typical passenger car as compared with the requirement for transporting even the smallest outboard boat motor.

Another highly important feature is the relationship between the mounting structure and weight distribution. A well designed inflatable boat 10 should support a fisherman comfortably with the boat remaining substantially level while in the water and with ample reserve flotation capacity. A motor mounting system that adds significant weight to an inflatable boat can disrupt the level of flotation of the boat and impair its safety. One of the significant features of the arrangement of this invention is the provision wherein the motor mounting system does not disturb the natural flotation of the boat or significantly add any weight that must be supported by the boat itself. As can be seen in FIG. 2, battery box 76 rests with a portion below the water level 26. The buoyancy of the battery box, including the buoyancy of cellular plastic foam 74, supports not only the weight of the battery contained within the battery box but substantially all the weight of the battery box bracket 46 and motor 64. In this way the entire system can be attached to a boat and the level of flotation of the boat is not changed perceptible nor does the weight of the system impair the safety of the boat since it is more or less self sufficient in providing its own flotation requirement.

Another important feature of the invention is the relationship between the location of motor 64 and battery box bracket 46. The bottom surface of the battery box bracket is provided by the bottom surface of cellular foam plastic sheet 74, or if such sheet is not employed, the bottom surface of battery box 76 if it is positioned directly within the battery box bracket 46, provides a large flat horizontal area immediately adjacent and above propeller 72. Thus, the bottom of the battery box or the bottom of the cellular foam plastic 74 provides an anti-cavitation plate for propeller 72. It is well known that a propeller spinning in water, particularly when not far below the water surface 26, can draw air from the surface and a column of air can be established that surrounds the propeller to substantially reduce the ability of the propeller to produce propulsion. For this reason, nearly all outboard motors, or inboard/outboard motors, have an integral anti-cavitation plate immediately above the propeller and between the propeller and the water surface. By this invention no anti-cavitation plate is required because of the unique relationship between motor 64 and battery box bracket 46.

In the embodiment of the invention illustrated in the drawing the orientation of submersible motor 64 is fixed, however, the direction of travel of the boat, either forward or backwards, can be controlled surprisingly well by the feet of the user. That is, the feet can be used like rudders to guide the boat. Optionally, the direction of motor 64 could be controlled such as by making mounting member 66 rotatable within tubular post 58. A handle could then be provided for rotating mounting member 66 to guide the motor.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A motor mounting system for an inflatable boat of the type having opposed first and second tubular gunwale sections extending from a tubular U-shaped stern section, the system comprising:

a band horizontally and contiguously positionable on a rearward surface of an inflatable boat, the band having opposed first and second ends;

a first strap that encircles a first section of an inflatable boat and said band adjacent said first end thereof to regain said band first end continuous to an inflatable boat;

a second strap that encircles a second section of an inflatable boat and said band adjacent said second end thereof to regain said band first end contiguous to an inflatable boat;

a bracket secured to said band at the stern of an inflatable boat and receiving a battery therein;

a submersible motor having a horizontal propeller shaft rotatably extending therefrom to which is affixed a propeller, the motor being positioned beneath and supported by said bracket; and a motor control supportable by a section of an inflatable boat and electrically interposed between said battery and said motor.

2. A motor mounting system according to claim 1 including a battery box removably receivable by said bracket, said battery being positioned within the battery box.

3. A motor mounting system according to claim 1 wherein said bracket includes a horizontally extending surface, said propeller being positioned below the surface and the surface serving as an anti-cavitation plate for said motor.

4. A motor mounting system according to claim 3 including a battery box removably receivable by said bracket, the battery box having a bottom providing said horizontally extending surface.

5. A motor mounting system according to claim 1 including:

an attachment system formed of a hook portion and a loop portion and having a first portionsecurable horizontally to an inflatable boat U-shaped stern; and an attachment system second portion secured to said band, the attachment system first and second portions being in alignment and removably attachable to each other.

6. A motor mounting system according to claim 2 wherein said battery box provides flotation to at least in part offset the weight of said bracket, battery and motor.

7. A motor mounting system usable on an inflatable boat comprising:

a frame removably attachable to the exterior surface of an inflatable boat;

a structural bracket formed of rigid members and secured to said frame;

a floatable battery box receivable by said bracket and having a lower surface;

a battery receivable within said battery box; and a submersible motor supported by said frame and having a generally horizontal propeller shaft extending therefrom having a propeller attached thereto, the propeller being positioned vertically below and in close proximity to said battery box lower surface, said battery box lower surface being dimensioned and positioned to provide an anti-cavitation plate for the propeller, flotation provided by said battery box at least partially offsetting the weight of said frame, bracket, battery and motor.

* * * * *